US007327664B2

(12) United States Patent
Kataoka et al.

(10) Patent No.: US 7,327,664 B2
(45) Date of Patent: Feb. 5, 2008

(54) OPTICAL RECORDING APPARATUS

(75) Inventors: Keiji Kataoka, Ibaraki (JP); Koji Doi, Ibaraki (JP); Yasuyuki Shibayama, Ibaraki (JP); Susumu Monma, Ibaraki (JP); Jyun Ogino, Ibaraki (JP); Masaru Hoshina, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 610 days.

(21) Appl. No.: 10/829,330

(22) Filed: Apr. 22, 2004

(65) Prior Publication Data

US 2004/0213130 A1 Oct. 28, 2004

(30) Foreign Application Priority Data

Apr. 25, 2003 (JP) ..... P2003-121463

(51) Int. Cl.
*G11B 7/00* (2006.01)

(52) U.S. Cl. ..... 369/112.27

(58) Field of Classification Search ..... None
See application file for complete search history.

(56) References Cited

U.S. PATENT DOCUMENTS 6,700,855 B2 * 3/2004 Horie ..... 369/112.21
6,894,712 B2 * 5/2005 Ishikawa et al. ..... 347/239
2005/0083826 A1 * 4/2005 Anatoliy et al. ..... 369/112.27

FOREIGN PATENT DOCUMENTS

JP 2001-337284 12/2001
JP 2001-343601 12/2001

* cited by examiner

*Primary Examiner*—Wayne Young
*Assistant Examiner*—Lixi Chow
(74) *Attorney, Agent, or Firm*—McGinn IP Law Group, PLLC

(57) ABSTRACT

An optical fiber array is constructed by using a plurality of laser modules, which guide a laser beam emitted from a semiconductor laser of a blue color wavelength to an optical fiber, such that beam emitting ends of respective optical fibers are aligned in one row at an equal interval, and the laser beam being output from the optical fiber array is used as a multibeam of an optical recording apparatus. A relative refractive index difference of the used optical fiber is set between 0.1% to 0.2%, and a core diameter is set to 4.5 μm or less, and also a mode field diameter of the optical fiber, i.e., a diameter of a beam spot emitted from the optical fiber is set to 3 μm or more.

13 Claims, 3 Drawing Sheets

OPTICAL RECORDING APPARATUS

BACKGROUND OF THE INVENTION

1. Field of the Invention

The present invention relates to an optical recording apparatus such as a laser printer for making an optical recording by using a semiconductor laser having a blue color wavelength (referred to as "blue color semiconductor laser" hereinafter).

2. Description of the Related Art

In the high-speed laser printer as a typical example of the optical recording apparatus, because the photosensitive material having the enough endurance must be employed, the selenium photosensitive drum that has a small sensitivity to a red color but is highly sensitive to a blue color, or the like is employed. Therefore, in the high-speed laser printer in the prior art, the optical system to which the argon laser to output a laser beam of a blue color wavelength of 488 nm is applied was employed.

A schematic view of an example of an optical system to which an argon laser 101 is applied is shown in FIG. 2. In this optical system, a laser beam emitted from the argon laser 101 is divided into multiple beams (five beams in FIG. 2) by a diffraction grating 102 to pass through a lens 103, then the beams are modulated by a multichannel acousto-optic modulator 104, and then irradiated onto a lens 105. The lens 103 and the lens 105 are provided to expand a beam diameter. In addition, the multiple beams passed through the lens 105 are reflected by reflecting mirror 106 to pass through a Dove prism 107, which adjusts a slant scanning angle of the multiple beams, and a cylindrical lens 108, which focuses the beam onto a rotating polygon mirror 110 in the paper feed direction, then are deflected collectively by the rotating polygon mirror 110, and then are irradiated onto a photosensitive drum 111 via scanning lenses 109. This process makes it possible to scan collectively the laser beam consisting of the multiple beams and to thus execute the printing at a high speed.

SUMMARY OF THE INVENTION

Because an argon laser and an multichannel acousto-optic modulator are very expensive, it becomes an obstacle to reduction in a cost of the high-speed laser printer. Therefore, an optical system utilizing a semiconductor laser, which has a wavelength of around 405 nm and is very inexpensive, is desired.

With the above, the present invention is aimed at realizing an optical system for multibeam-scanning by using blue color semiconductor lasers at a low cost. In particular, it is a subject of the present invention to provide an optical fiber array most suitable for the case where a plurality of laser modules, guide laser beams from the blue color semiconductor lasers to optical fibers, and an optical fiber array is formed by aligning light emitting ends of respective optical fibers in one row at an equal interval, such that the laser beams output from the optical fiber array are used as a multibeam.

In order to overcome the above problem, the present invention provides an optical recording apparatus which includes a semiconductor laser having a blue color wavelength and generating a light beam, an optical fiber, a laser module which guides the beam of the semiconductor laser to the optical fiber and an optical recording medium which is applied an output beam from the optical fiber to form a latent image, in which a relative refractive index difference of the optical fiber is in a range of from 0.1% to 0.2%, a core diameter of the optical fiber is 4.5 μm or less and a diameter of a beam spot emitted from the optical fiber is 3 μm or more.

According to another aspect of the invention, the optical recording apparatus of the present invention further includes a plurality of semiconductor lasers each having a blue color wavelength and generating a light beam, a plurality of laser modules for guiding the light beams of the semiconductor lasers to optical fibers in which respective optical fibers are aligned at an equal interval in an array.

DETAILED DESCRIPTION OF THE PREFERRED EMBODIMENTS

An example of the present invention will be explained with reference to the drawings hereinafter.

Figure 1:
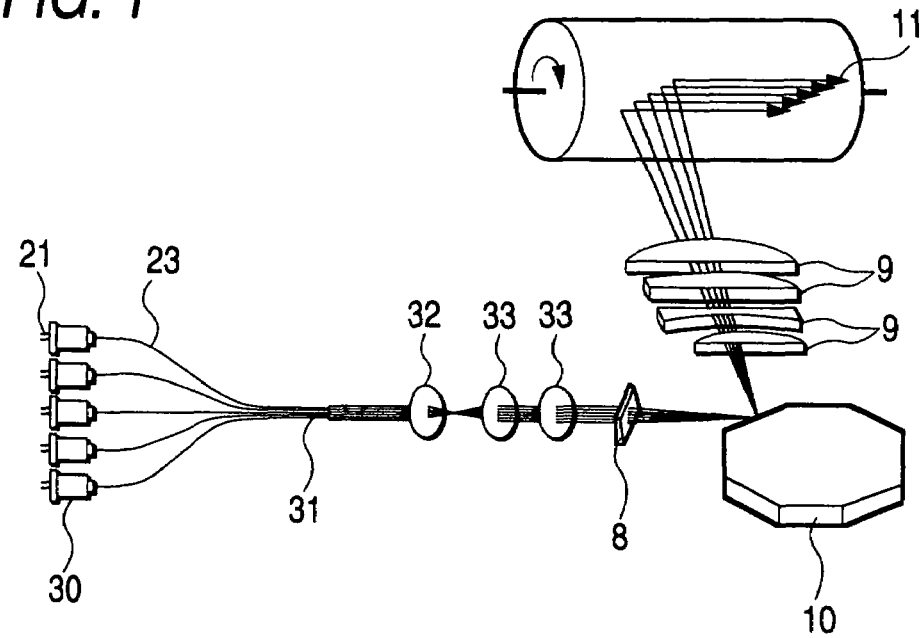
FIG. 1 is a schematic view showing an optical system of an optical recording apparatus using optical fibers of the present invention.
Figure 2:
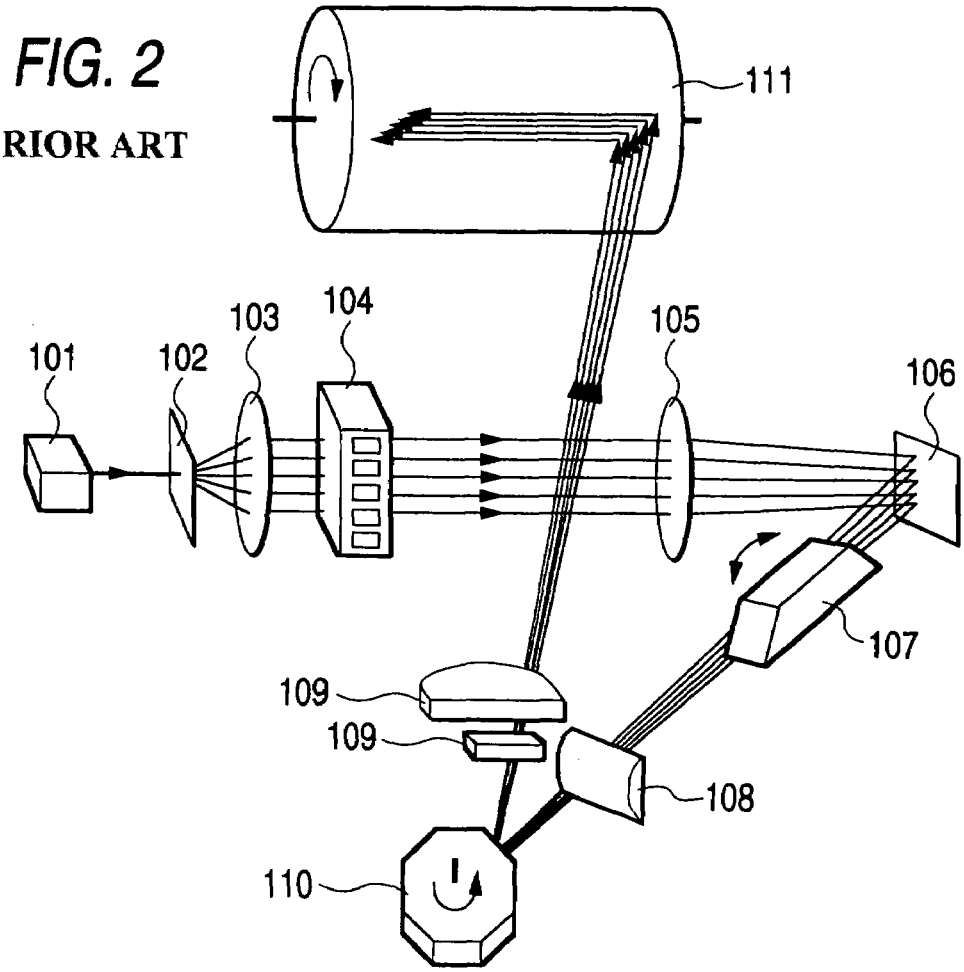
FIG. 2 PRIOR ART
FIG. 2 is a schematic view showing an example of an optical system to which an argon laser is applied in the prior art.

FIG. 1 is a schematic view showing an optical system of an optical recording apparatus using optical fibers of the present invention. A blue color semiconductor laser 21 acting as a light emitting source of a beam is mounted onto one end of a laser module 30. In this example, the optical system is constructed to generate five beams by five laser modules 30. An optical fiber 23 is mounted onto the other end of the laser module 30. These optical fibers 23 are constructed as an optical fiber array 31 in which these fibers are aligned in an array by a holding mechanism (not shown). Therefore, the beam generated from the blue color semiconductor laser 21 comes up to the optical fiber array 31 via the laser module 30 and, the optical fiber 23. Then, a plurality of beams emitted from the optical fiber array 31 are transmitted through a collimator lens 32 such that respective beams constitute a parallel beam. Then, the multibeams output from the collimator lens 32 are subjected to conversion of a beam diameter by a lens 33 as a beam expander, then are focused onto a rotating polygon mirror 10 in the paper feed direction by a cylindrical lens 8, then are deflected collectively by a rotating polygon mirror 10, and then are irradiated onto a photosensitive drum 11 via scanning lenses 9.

Figure 3:
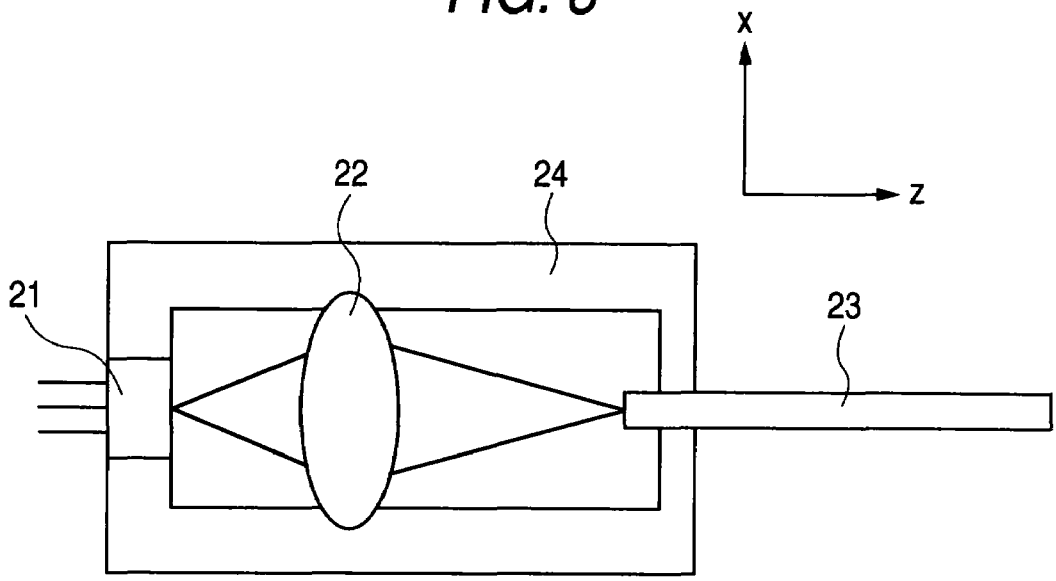
FIG. 3 is a schematic sectional view showing a configuration of a laser module as an example of the present invention.

FIG. 3 is a schematic sectional view showing a configuration of a laser module 30 as an example of the present invention.

The blue color semiconductor laser 21 is mounted onto one end of a housing 24 of the laser module 30, and the optical fiber 23 is arranged in an opposing position via a lens 22. The lens 22 is used to converge a divergent beam emitted from the blue color semiconductor laser 21 onto the optical fiber 23. The beam emitted from the optical fiber 23 must have a spatial single mode.

Now, explanation will be made of the single mode hereunder. The single mode indicates such a state that a spot of the beam irradiated onto the photosensitive material has a single peak circular or elliptic Gaussian light intensity distribution, and is the indispensable condition to the optical recording of high quality. In contrast, the multi mode indicating such a state that the spot of the beam irradiated onto the photosensitive material has a plural peak light intensity distribution or is formed like a doughnut is unsuitable for the beam used to make the optical recording.

Next, explanation will be made of the optical fiber applied in the present invention hereunder. Normally the optical fiber has a double-layered structure consisting of an outer peripheral portion called a clad made of quartz glass as a main material, and a core portion called a core made of material in which germanium is doped into the quartz glass. A diameter of the clad is about 125 μm and a diameter of the core is 10 μm. Also, a relative refractive index difference (described later) of the clad and the core is in excess of 0.3%.

Since normally the wavelength of the semiconductor laser used in the optical communication is 1.6 μm of the infrared ray, the above configuration causes no trouble. However, if the beam emitted from the blue color semiconductor laser of a wavelength of around 405 nm is guided by using the optical fiber having such configuration, it is impossible to generate the beam having the single mode that is suitable for the optical recording. The reason for this is that, in the case of the blue color semiconductor laser of a wavelength 405 nm, a core diameter should be reduced conspicuously small based on a wavelength ratio and thus a diameter of the mode propagating through the optical fiber, i.e., a diameter 2 $W_F$ of the beam spot emitted from the optical fiber must be reduced. However, if the diameter 2 $W_F$ of the beam spot is excessively reduced, tolerance of positional displacement of the portion in which the beam converged by the lens 22 is coupled to the optical fiber 23 is reduced. Thus, the optical system with high reliability cannot be realized.

For example, if a diameter of the beam spot of the laser beam on a plane of incidence of the optical fiber is set to 2 $w_x$ and the optical fiber is displaced in the x direction in FIG. 3 by $\Delta_x$, a coupling efficiency to the optical fiber is reduced in compliance with formula (1).

$$\eta_x = \exp\left(-\frac{2\Delta_x^2}{w_F^2 + w_x^2}\right) \tag{1}$$

That is, if it is assumed that $W_F = W_X$ is set, such coupling efficiency is reduced 1/e at $\Delta_x = W_F$. If an allowable alignment error of the optical fiber is set to $\Delta_x \geqq 1.5$ μm, it is needed to set the diameter 2 $W_F$ of the beam spot to 3 μm or more.

Meanwhile, it is well known that the condition required to form the optical fiber, in which the single mode can be generated at the wavelength of the blue color semiconductor laser, is that a parameter V must satisfy the following condition expressed by formula (2).

$$V = \frac{2\pi}{\lambda} a \sqrt{(n_1^2 - n_2^2)} < 2.405 \tag{2}$$

where λ is a wavelength of light, 2*a* is a core diameter, $n_1$ is a refractive index of the core, and $n_2$ is a relative refractive index of the clad.

Figure 4:
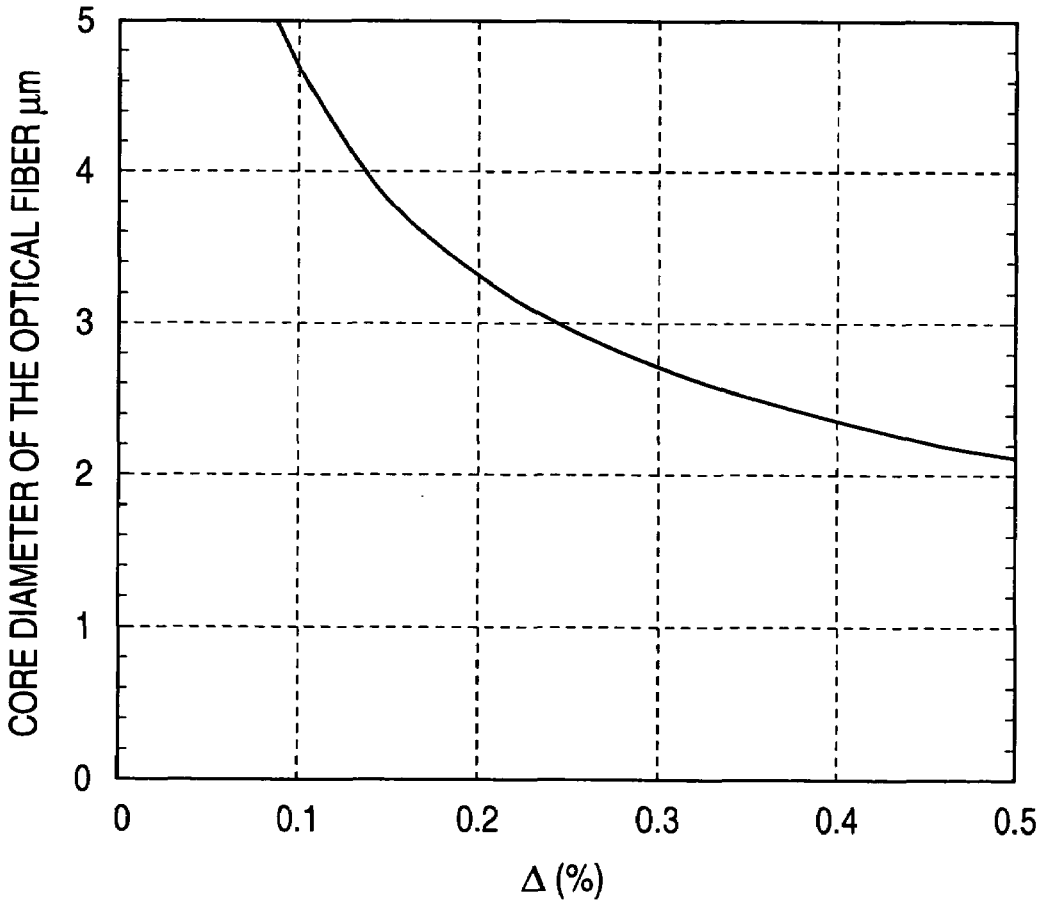
FIG. 4 is a graph showing calculated results of single mode conditions of an optical fiber for a blue color semiconductor laser.

A graph indicating Formula 2 by assuming the refractive index of the clad as 1.4696 is shown in FIG. 4. In FIG. 4, Δ is the relative refractive index difference and is expressed by formula (3).

$$\Delta = \frac{n_1 - n_2}{n_2} \tag{3}$$

In FIG. 4, the single mode can be realized in an area in which the core diameter is given under the curve. However, it is found that, in the formation of the optical fiber, it is difficult to form stably the optical fiber whose relative refractive index difference Δ is 0.1% or less. The reason for this is that, when germanium is doped into the quartz glass serving as the core material, it is very difficult to control a doping amount in such a way that the relative refractive index difference Δ is set to 0.1% or less. Therefore, it is understood from FIG. 4 that, when the difference Δ is set to 0.1% or more, it is essential to set the core diameter to almost 4.5 μm or less.

Figure 5:
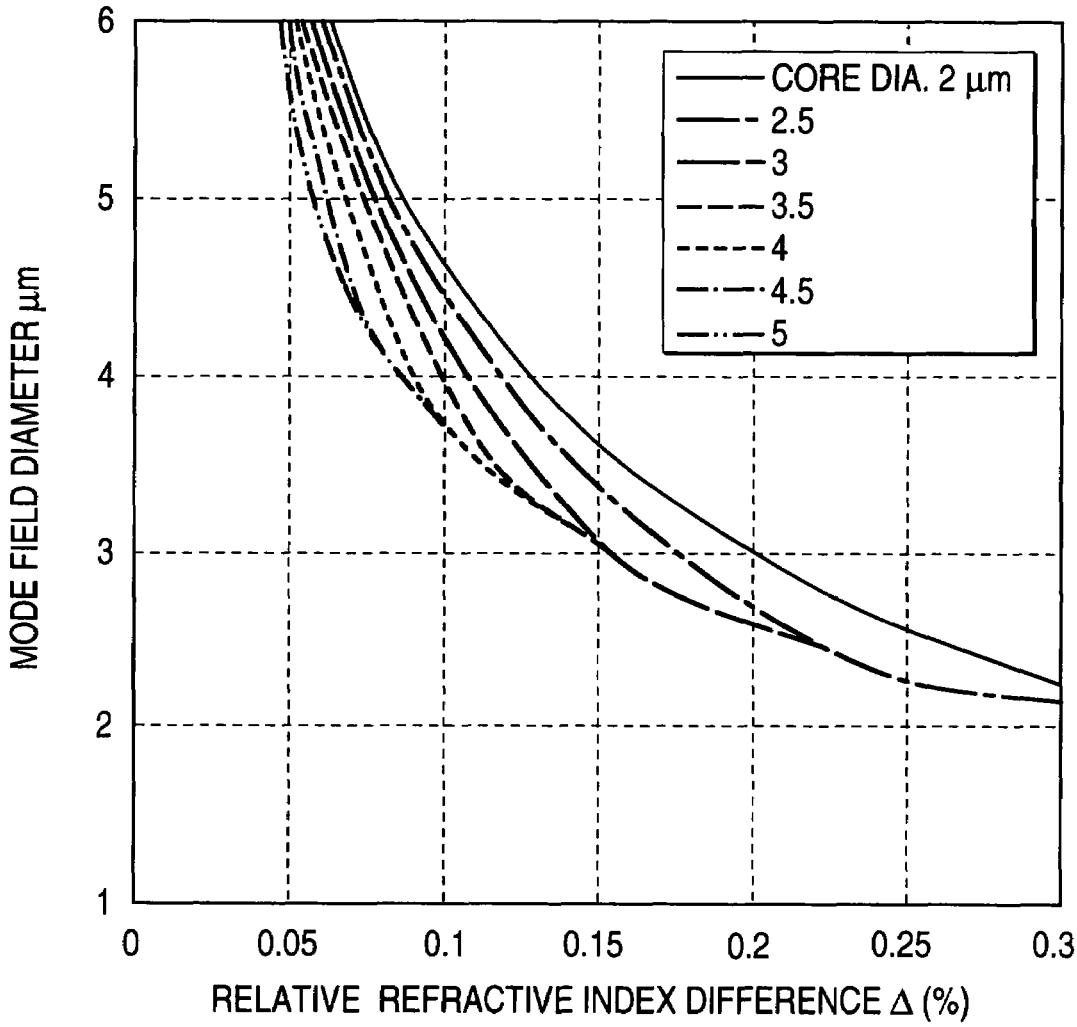
FIG. 5 is a graph showing calculated results of a mode field diameter of the optical fiber for the blue color semiconductor laser.

Meanwhile, the mode propagating through the optical fiber is expressed by a Bessel function. Calculated results of a mode field diameter in this mode, i.e., a diameter of the spot emitted from the optical fiber are shown in FIG. 5. An axis of abscissa denotes the relative refractive index difference and an axis of ordinate denotes the mode field diameter, and the core diameter is used as a parameter. It is appreciated from this results that the relative refractive index difference should be set to 0.2% or less to get the mode field diameter of 3 μm or more, which is an allowable range of the above alignment displacement.

As described above, in the optical system that guides the laser beams from the semiconductor lasers having the blue color wavelength to the optical fibers and uses the laser beams output from the optical fibers, the optimum optical system available for the optical recording apparatus can be provided if the relative refractive index difference and the core diameter out of the characteristics of the used optical fiber are set to 0.1% to 0.2% and 4.5 μm or less respectively and also the mode field diameter of the optical fiber, i.e., the diameter of the beam spot emitted from the optical fiber is set to 3 μm or more.

In this case, in the present example, explanation is made of the case that the wavelength of the blue color semiconductor laser is 405 nm taken as an example. Advantages of the present invention can be achieved if the wavelength of the blue color semiconductor laser is in a range of 390 nm to 450 nm.

According to the apparatus of the present invention, the blue color semiconductor laser can be employed in place of the argon laser that is large in size and is expensive, and thus improvement in the reliability of the apparatus and reduction in the cost can be achieved.

What is claimed is:

1. An optical recording apparatus comprising:

a semiconductor laser having a blue color wavelength and generating a light beam;

an optical fiber that transmits the light beam in a single mode;

a laser module which guides the light beam of the semiconductor laser to the optical fiber; and an optical recording medium to which is applied an output beam from the optical fiber to form a latent image, wherein a relative refractive index difference between a core and a clad of the optical fiber is in a range of from 0.1% to 0.2%, a core diameter of the optical fiber is 4.5 μm or less and a diameter of a beam spot emitted from the optical fiber is 3 μm or more, wherein a spot of the output beam applied to the optical recording medium has a single peak circular light intensity distribution.

2. The optical recording apparatus of claim 1, wherein a wavelength of the semiconductor laser is in a range of from 390 nm to 450 nm.

3. The optical recording apparatus of claim 1, wherein the latent image is visualized and printed on a recording medium.

4. An optical recording apparatus comprising:

a semiconductor laser having a blue color wavelength and generating a light beam;

an optical fiber that transmits the light beam in a single mode;

a laser module which guides the light beam of the semiconductor laser to the optical fiber; and an optical recording medium to which is applied an output beam from the optical fiber to form a latent image, wherein a relative refractive index difference between a core and a clad of the optical fiber is in a range of from 0.1% to 0.2%, a core diameter of the optical fiber is 4.5 μm or less and a diameter of a beam spot emitted from the optical fiber is 3 μm or more, wherein a spot of the output beam applied to the optical recording medium has a single peak elliptic Gaussian light intensity distribution.

5. The optical recording apparatus of claim 4, wherein a wavelength of the semiconductor laser is in a range of from 390 nm to 450 nm.

6. The optical recording apparatus of claim 4, wherein the latent image is visualized and printed on a recording medium.

7. An optical recording apparatus comprising:

a semiconductor laser having a blue color wavelength and generating a light beam;

an optical fiber that transmits the light beam in a single mode;

a laser module which guides the light beam of the semiconductor laser to the optical fiber; and an optical recording medium to which is applied an output beam from the optical fiber to form a latent image, wherein a relative refractive index difference between a core and a clad of the optical fiber is in a range of from 0.1% to 0.2%, a core diameter of the optical fiber is 4.5 μm or less and a diameter of a beam spot emitted from the optical fiber is 3 μm or more , wherein the semiconductor laser comprises a plurality of semiconductor lasers;

the laser module comprises a plurality of laser modules, the optical fiber comprises a plurality of optical fibers, wherein respective optical fibers are aligned at an equal interval in an array, wherein a spot of the output beam applied to the optical recording medium has a single peak circular light intensity distribution.

8. The optical recording apparatus of claim 7, wherein a wavelength of the semiconductor laser is in a range of from 390 nm to 450 nm.

9. The optical recording apparatus of claim 7, wherein the latent image is visualized and printed on a recording medium.

10. An optical recording apparatus comprising:

a semiconductor laser having a blue color wavelength and generating a light beam;

an optical fiber that transmits the light beam in a single mode;

a laser module which guides the light beam of the semiconductor laser to the optical fiber; and an optical recording medium to which is applied an output beam from the optical fiber to form a latent image, wherein a relative refractive index difference between a core and a clad of the optical fiber is in a range of from 0.1% to 0.2%, a core diameter of the optical fiber is 4.5 μm or less and a diameter of a beam spot emitted from the optical fiber is 3 μm or more, wherein the semiconductor laser comprises a plurality of semiconductor lasers;

the laser module comprises a plurality of laser modules, the optical fiber comprises a plurality of optical fibers, wherein respective optical fibers are aligned at an equal interval in an array, wherein a spot of the output beam applied to the optical recording medium has a single peak elliptic Gaussian light intensity distribution.

11. The optical recording apparatus of claim 10, wherein a wavelength of the semiconductor laser is in a range of from 390 nm to 450 nm.

12. The optical recording apparatus of claim 10, wherein the latent image is visualized and printed on a recording medium.

13. An optical recording apparatus comprising:

a semiconductor laser having a blue color wavelength and generating a light beam;

an optical fiber;

a laser module which guides the light beam of the semiconductor laser to the optical fiber; and an optical recording medium to which is applied an output beam from the optical fiber to form a latent image, wherein a relative refractive index difference between a core and a clad of the optical fiber is in a range of from 0.1% to 0.2%.

* * * * *